US006152396A

United States Patent [19]

Rapila et al.

[11] Patent Number: 6,152,396

[45] Date of Patent: Nov. 28, 2000

[54] VARIABLE-FORCE DISCHARGE MECHANISM FOR MATERIALS LOADED ON A REEL

[75] Inventors: Tero Rapila, Tampere; Pertti Lehto, Laihia, both of Finland

[73] Assignee: T-Drill Oy, Laihia, Finland

[21] Appl. No.: 09/293,105

[22] Filed: Apr. 16, 1999

[30] Foreign Application Priority Data

Apr. 17, 1998 [FI] Finland ..... 980854

[51] Int. Cl.[7] ..... B65H 77/00

[52] U.S. Cl. ..... 242/420.6

[58] Field of Search ..... 242/420.6, 420, 242/421.6, 421.7

[56] References Cited

U.S. PATENT DOCUMENTS

| | | | |
|---|---|---|---|
| 2,681,184 | 6/1954 | Thomas . | |
| 3,240,058 | 3/1966 | Foster | 242/421.6 X |
| 3,509,595 | 5/1970 | Mzder, Jr. et al. . | |
| 4,151,594 | 4/1979 | Stern | 242/421.7 X |
| 4,316,587 | 2/1982 | Gauthier | 242/421.6 X |
| 4,318,513 | 3/1982 | Martinez | 242/421.6 X |
| 4,838,498 | 6/1989 | Huth | 242/420.6 X |
| 5,186,409 | 2/1993 | Kansaku | 242/421.6 |
| 5,632,175 | 5/1997 | Green et al. | 72/130 |
| 5,713,533 | 2/1998 | Nordlof et al. | 242/420.6 X |
| 5,887,816 | 3/1999 | Jones | 242/420.6 |

FOREIGN PATENT DOCUMENTS

| | | | |
|---|---|---|---|
| 663442 | 5/1963 | Canada | 242/421.6 |
| 114365 | 8/1984 | European Pat. Off. | 242/420.6 |
| 275852 | 12/1987 | European Pat. Off. . | |
| 8609191 | 8/1986 | Germany . | |
| 3525022 | 1/1987 | Germany . | |
| 3702702 | 9/1987 | Germany . | |
| 3929897 | 3/1991 | Germany . | |
| 642250 | 1/1979 | U.S.S.R. | 242/421.6 |
| 1048175 | 11/1966 | United Kingdom | 242/421.7 |
| WO 97/02203 | 1/1997 | WIPO . | |
| WO 98/27002 | 6/1998 | WIPO . | |

*Primary Examiner*—Donald P. Walsh
*Assistant Examiner*—Collin A. Webb
*Attorney, Agent, or Firm*—Klauber & Jackson

[57] ABSTRACT

The invention relates to a variable-force discharge mechanism for materials loaded on a reel. Some material is drawn with an external device (1) from a reel (2) around a reversing wheel (6), said reel being driven or decelerated with a discharge motor (3). In order to reduce the tensile stress fluctuations of a material (5), the reversing wheel (6) is afforded a certain displacement (A), within which a resilient assembly (7–9) produces a counter-force for a traction force (F). The counter-force produced by the resilient assembly is created by a piston-cylinder unit (7), having its gas pressure adjustable by a regulating valve (9) which sustains an adjustable, constant counter-force.

1 Claim, 1 Drawing Sheet

VARIABLE-FORCE DISCHARGE MECHANISM FOR MATERIALS LOADED ON A REEL

BACKGROUND OF THE INVENTION

The present invention relates to a variable-force discharge mechanism for materials loaded on a reel, comprising a material reel a discharge motor for assisting in unloading the reel an external device for applying a discharging traction force to a material to be discharged a reversing wheel between the material reel and the external device, and a resilient assembly in connection with the reversing wheel for adjusting the discharge force.

This type of prior known mechanisms have employed weights or a spring as a resilient means for adjusting a discharge force. A problem associated with the use of counterweights is a major inertia which, as a result of speed fluctuations, subjects the material to major stress fluctuations. A problem in spring loading is the variation of a counter-force over a long operating range as well as the difficulty of swiftly adjusting the starting level of a counter-force to comply with the change of materials to be discharged.

BRIEF SUMMARY OF THE INVENTION

When applying the invention, the relevant materials to be discharged are especially pipes, rods, wires or cables of metal or plastics, which are discharged from a reel to an external device for effecting a cutting, a bending, a punching, a shaping or the like working process.

An object of the invention is to provide a discharge mechanism of the above type, wherein the tensile stress fluctuations applied to a material can be largely stabilized without the above-mentioned drawbacks.

BRIEF DESCRIPTION OF THE DRAWINGS

One exemplary embodiment of the invention will now be described in more detail with reference made to the accompanying drawing, which depicts a discharge mechanism of the invention according to one embodiment thereof schemantially in a lateral view.

DETAILED DESCRIPTION OF THE INVENTION

Figure 1:
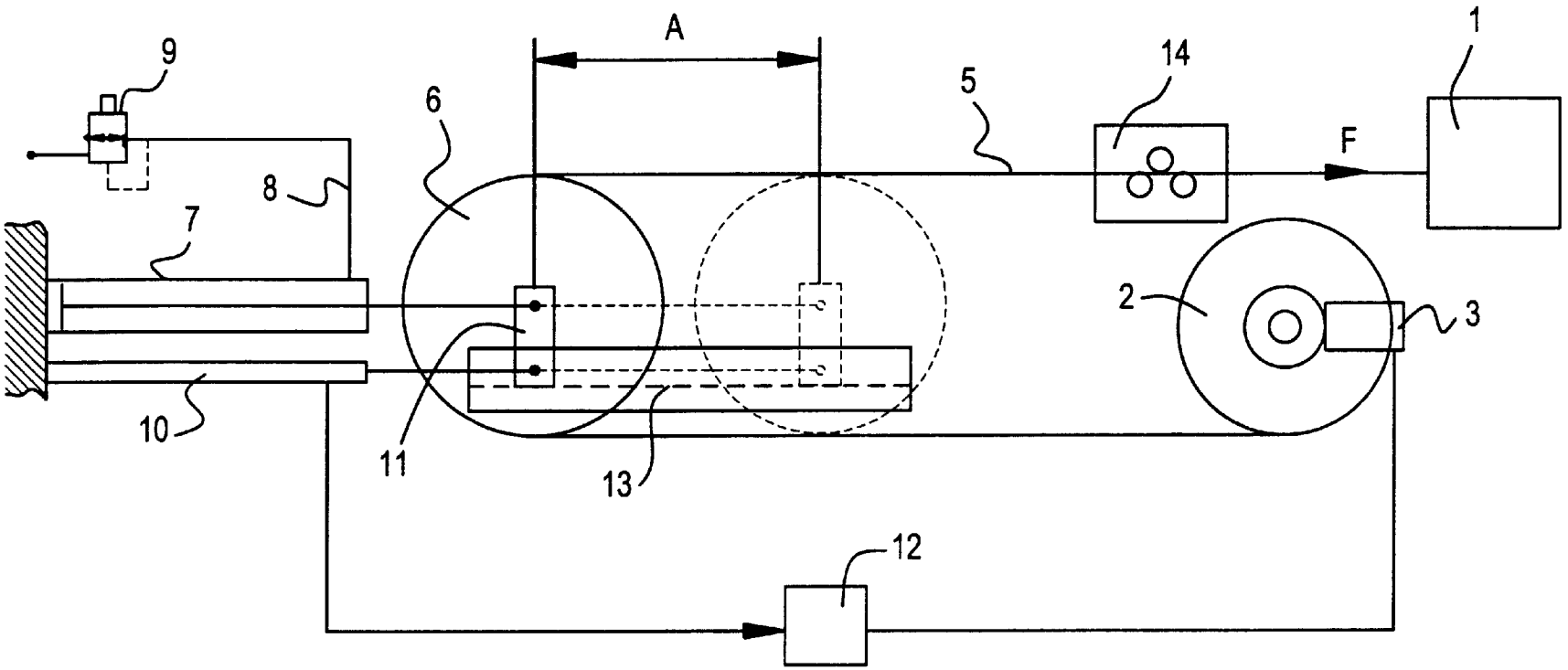

An external device 1 draws a material 5 with a force F from a reel 2. The material 5 to be discharged comprises a pipe, a rod, a wire or a cable of metal or plastics. The material 5 is processed in the external device 1. The process in question could be cutting, bending, punching, shaping or the like. In a typical case, such processes require that the material 5 be drawn intermittently with intermissions between the drawing cycles. Since the material reel 2 can be very heavy indeed, the material 5 would be subjected to major fluctuations of tensile stress unless the material 5 were carried through a resilient assembly for stabilizing tensile stresses.

As for this invention, the resilient assembly comprises a pneumatic piston-cylinder unit 7 associated with a reversing wheel 6, wherein the gas pressure producing a counter-force is adjustable with a regulating valve 9 which, through the intermediary of a tube 8, sustains a constant pressure in the space of the cylinder 7 next to the piston rod. Thus, the reversing wheel 6 is able to move over a certain displacement A towards the external device 1 in such a way that a counter-force produced for the force F remains nearly constant. While the drawing speed fluctuates and the reel 2 has a fluctuating rotational speed, the material 5 will nevertheless have a tensile stress which remains substantially constant. The level of tensile stress is determined on the basis of a gas pressure existing in the cylinder 7. In addition, the valve 9 can be used for setting various levels of constant pressure in the cylinder 7, which enables the adjustment of a variety of tensile stress levels selected in accordance with any given material 5 to be discharged.

Hence, the resilient assembly 7–9 has an operating range which allows the certain displacement A for the reversing wheel 6. In order to hold the resilient assembly 7–9 within the operating range, a discharge motor 3 is adapted to be controlled by a sensor 10 for the displacement of the reversing wheel 6 in such a way that the reel has discharge rate which increases as the reversing wheel 6 travels towards the material reel 2 and the external device 1, and said discharge rate being reduced as the reversing wheel 6 travels in the opposite direction.

The displacement sensor can be continuously operating, e.g. a linear potentiometer, or it may operate stepwise by means of several sequential position sensors. A signal received from the displacement sensor 10 is used for controlling, through the intermediary of a regulating unit 12, the rotating speed of the motor 3 or the transmission ratio between the motor 3 and the reel 2. In the illustrated case, the cylinder 7 has its piston rod and the displacement sensor has its movable component attached to an element 11, which is movable along with the reversing wheel 6 and which is supported to be linearly reciprocating along slide bars 13. This motion of the reversing wheel 6 occurs as a result of the fluctuations of reversed forces produced by the resilient assembly 7–9 and the traction device 1. What is essential is that this action of the reversing wheel 6 is parallel to the discharging traction force F and the drawing direction of the material 5, the direction of material 5 present between the reversing wheel 6 and the traction device 1 remaining unchanged. Thus, it is possible to use between the reversing wheel 6 and the traction device 1 an alignment unit 14 provided with straightening rollers, having a straightening alignment which is always parallel to the material drawing direction.

Furthermore, the reversing wheel 6 must have a sufficient radius in order not to shape the material but merely to deflect or reverse its traveling direction by 180°.

The arrangement of the invention is capable of bringing the material to the traction device 1 as straight as possible. The components are mounted on frame structures, which are not shown and which a skilled person is able to implement in a variety of ways.

Another important feature in the invention is that the resilient assembly 7–9 functioning as "a buffer storage" for tensile stress produces an almost permanently constant counter-force over the relatively long displacement A. The control of discharge rate effected by means of the displacement sensor 10 makes sure that the resilient assembly always remains within its operating range.

The invention is not limited to the above exemplary embodiment. For example, the resilient assembly may have its pneumatic counter-pressure based on a pressure produced by a fan applying to the linearly movable element. The resilient assembly can also be constructed hydraulically by using a flow-throttle regulating valve, which is controlled by means of a pressure sensor monitoring the pressure that produces the counter-force. Many other modifications of structural design are also conceivable within the scope of the following claims.

What is claimed is:

1. A variable-force discharge mechanism for pipe or rod of a metal material loaded on a reel, said mechanism comprising:

a reel (2) for containing metal material in the form of pipe or rod, a discharge motor (3) for assisting in unloading the reel (2), an external traction device (1) for applying a discharging traction force (F) to the metal material to be discharged, said external traction device (6) adapted to draw said metal material and to exert said discharging traction force in a predetermined direction, a reversing wheel (6) between said reel (2) and said external traction device (1), said reversing wheel adapted to travel along slide bars (13), an alignment unit (14) between said reversing wheel (6) and said external traction device (1), said alignment unit (14) having straightening rollers having straightening alignment which is parallel to said predetermined drawing direction, and a resilient assembly (7–9) in connection with said reversing wheel (6) for adjustable creating a counter-force produced by said resilient assembly (7–9) in a direction opposite to said predetermined direction of said discharging traction force (F), said counterforce being adapted to be produced by a piston-cylinder unit (7) having a gas pressure that is adjustable by means of a regulating valve (9) sustaining said adjustable counter force, said resilient assembly (7–9) having an operating range which allows a certain displacement (A) for said reversing wheel (6) caused by said discharging traction force in said predetermined direction against said counter-force, said resilient assembly (7–9) producing, when operating within this range, said counter-force determined by said adjustable gas pressure for said discharging traction force (F) and thus reducing the fluctuation of tensile stress applied to the material (5), a displacement sensor (10) for sensing the displacement of said reversing wheel (6) is adapted to control said discharge motor (3) for holding said resilient assembly (7–9) within said operating range, said displacement sensor (10) adapted to supply a regulating unit (12) of said discharge motor (3) continuously or stepwise with a regulation signal variable as a function of said reversing wheel displacement, said regulation signal increasing the discharge rate of said reel (2) as said reversing wheel (6) is displaced towards said reel (2) and said external traction device (1), wherein as a result of the fluctuation of forces produced by the resilient assembly (7–9) and said external traction device (1), the reversing wheel (6) is adapted to travel along said slide bars (13) linearly back and forth and parallel to said discharging traction force (F) and the drawing action of the material (5) whereby, when the material is moving, the material (5) present between said reversing wheel and said external traction device (1) maintains its direction unchanged.

* * * * *